US006938675B2

(12) United States Patent
Kokubunji et al.

(10) Patent No.: US 6,938,675 B2
(45) Date of Patent: Sep. 6, 2005

(54) HEAT EXCHANGER

(75) Inventors: Hiroshi Kokubunji, Kariya (JP); Tsukasa Arimura, Nagoya (JP); Yoshitake Hoshino, Nishikamo-gun (JP)

(73) Assignee: DENSO Corporation, Kariya (JP)

( * ) Notice: Subject to any disclaimer, the term of this patent is extended or adjusted under 35 U.S.C. 154(b) by 180 days.

(21) Appl. No.: 09/974,063

(22) Filed: Oct. 9, 2001

(65) Prior Publication Data

US 2002/0040776 A1 Apr. 11, 2002

(30) Foreign Application Priority Data

Oct. 11, 2000 (JP) ..... 2000-310867
Jul. 16, 2001 (JP) ..... 2001-215654

(51) Int. Cl.[7] ..... F28F 9/00
(52) U.S. Cl. ..... 165/11.1; 165/70; 165/140
(58) Field of Search ..... 165/140, 174, 165/11.1, 70

(56) References Cited

U.S. PATENT DOCUMENTS 2,037,845 A * 4/1936 Young ..... 165/144
2,505,790 A * 5/1950 Panthofer ..... 165/140
3,855,682 A * 12/1974 Chartet ..... 29/890.046
5,099,912 A * 3/1992 Tajima et al. ..... 165/133
5,127,466 A * 7/1992 Ando ..... 165/67
5,375,760 A * 12/1994 Doko ..... 228/183
5,465,783 A * 11/1995 O'Connor ..... 165/134.1
6,394,176 B1 * 5/2002 Marsais ..... 165/140
6,478,078 B1 * 11/2002 Matsuzaki et al. ..... 165/133

FOREIGN PATENT DOCUMENTS

| | | | |
|---|---|---|---|
| EP | 0859209 | 8/1998 | |
| FR | 2785376 | 5/2000 | |
| JP | 04-369396 A | * 12/1992 | ..... F28F/9/02 |
| JP | A5-272889 | 10/1993 | |
| JP | 05272889 A | * 10/1993 | ..... F28F/9/02 |
| JP | 09/152296 | 6/1997 | |
| JP | A10-111086 | 4/1998 | |

OTHER PUBLICATIONS

"Integral Radiator With Multiple Circuits", from Research Disclosure Nov. 1994, No. 367, p. 36709.*

* cited by examiner

*Primary Examiner*—Allen J. Flanigan
(74) *Attorney, Agent, or Firm*—Harness, Dickey & Pierce, PLC

(57) ABSTRACT

In order to enhance the working efficiency of assembling a heat exchanger in which two types of heat exchangers are integrated, there is provided a heat exchanger in which the size of the dummy tubes, which are the third tubes arranged in the portion between the first and the second radiator, and that of the first and the second tubes are made to be the same and further the size of the fins arranged between the dummy tubes and that of the first and the second fins are made to be the same. In order to reduce the occurrence of defective brazing of the separator to the header tank and in order to make it possible to easily repair the defective brazing portion, there is provided a hole in a portion of the header tank.

11 Claims, 5 Drawing Sheets

HEAT EXCHANGER

BACKGROUND OF THE INVENTION

1. Field of the Invention

The present invention relates to a heat exchanger in which two types of heat exchangers are integrated into one body. The present invention is effectively used for a hybrid automobile in which an internal combustion engine and electric motor are combined with each other so as to drive the automobile.

2. Description of the Related Art

In general, it is necessary for a hybrid automobile to have two types of radiators. One is a first radiator to cool an engine coolant circulating in an engine (internal combustion engine), and the other is a second radiator to cool an electric system coolant circulating in an electric motor and a control circuit for the motor.

In this connection, the appropriate coolant temperature and pressure of the engine coolant and those of the electric system coolant are different from each other. Therefore, when both coolants are cooled in the same radiator, the cooling efficiency is deteriorated, that is, cooling both coolants in the same radiator is not advantageous.

In order to solve the above problems, Japanese Unexamined Patent Publication No. 10-111086 discloses the following technique. That is, in a radiator composed of a plurality of tubes, in which coolant is circulating, and header tanks, which are arranged at longitudinal end portions of the tubes and communicating with the tubes, each header tank is separated by a separator (bulkhead) so that a portion in which the engine coolant is circulating and a portion in which the electric system coolant is circulating are separated from each other. In this way, the radiator to cool the engine coolant (which will be referred to as the first radiator hereinafter) and the radiator to cool the electric system coolant (which will be referred to as the second radiator hereinafter) are integrated into one body.

However, in the invention described above, between the first and the second radiator, there is provided a heat insulating region in which no fins are arranged, and there is provided a join plate, the shape and size of which are different from those of the cooling fins, in this heat insulating region.

Therefore, in the invention disclosed in the above patent publication, when the tubes and fins are successively laminated on each other in the case of assembling the radiator, it is necessary to specify a position at which the join plate is arranged. Therefore, the working efficiency is low when the radiator is assembled.

Further, in the invention described in the above patent publication, since the join portion of the separator 10 is located in the header tank 30 communicating with the tubes 20 as shown in FIG. 7, for example, in the process of brazing, even if brazing of the separator 10 to the header tank 30 is defective, it is impossible to repair this defective portion. Accordingly, the yield of the product is lowered.

In the case of brazing, it is preferable that the brazing portion is coated with flux. However, in the invention described in the above patent publication, since the join portion of the separator 10 is located in the header tank 30, the separator 10 must be inserted into the tank 30 from a slit hole formed in the header tank 30 after the separator 10 has been previously coated with flux.

In this case, when the slit hole is excessively larger than the thickness of the separator 10, a large gap is formed between the slit hole and the separator 10, which might cause a defective join. On the contrary, when the slit hole is made relatively small, flux coated on the surface of the separator 10 is removed when inserting the separator 10 into the slit hole. As a result, the separator 10 is defectively brazed to the header tank 30.

SUMMARY OF THE INVENTION

In view of the above points, it is an object of the present invention to enhance the working efficiency of assembling a heat exchanger in which two types of heat exchangers are integrated into one body.

It is another object of the present invention to reduce the occurrence of a defective brazing join at which a separator is brazed to a header tank. Also, it is still another object of the present invention to provide an arrangement of a separator and header tank in which a defective brazing join can be easily repaired.

In order to accomplish the above object, the present invention provides a heat exchanger, which is an embodiment, comprising: a plurality of first tubes (111) in which a first fluid circulates; first fins (112) for facilitating heat exchange, the first fins (112) being arranged between the first tubes (111); a plurality of second tubes (121) in which a second fluid circulates; second fins (122) for facilitating heat exchange, the second fins (122) being arranged between the second tubes (121); header tanks (130) communicating with both the tubes (111, 121), the header tanks (130) being arranged at both longitudinal end sides of both the tubes (111, 121); at least two pieces of separators (134) for dividing a space in the header tank (130) into a first space (131) communicating with the first tubes (111) and a second space (132) communicating with the second tubes (121), the two pieces of separators (134) composing a third space (133) between the first space (131) and the second space (132); at least two pieces of third tubes (dummy tubes) (140) for connecting a portion **(130*d*) corresponding to the third space (133) of the header tank (130) on one longitudinal end side of both the tubes (111, 121) with a portion (130*d*) corresponding to the third space (133) of the header tank (130) on the other longitudinal end side; and a fin (141) arranged between the third tubes (140), wherein the size of the first tubes (111) and the second tubes (121) is the same as that of the third tubes (140), and the size of the first fins (112) and the second fins (122) is the same as that of the fin (141)**.

Due to the foregoing, it is possible to assemble a heat exchanger by successively laminating the tubes and fins without distinguishing the third tubes (140) from the first tubes (111) and the second tubes (121) and also without distinguishing the first fins (112) and the second fins (122) from the fin (141) in process of assembling the heat exchanger. Accordingly, it is possible to enhance the working efficiency of assembling the heat exchanger.

A hole (135) for communicating the third space (133) with the outside of the header tank (130) may be formed in the third space corresponding portion **(130*d*) of the header tank (130) corresponding to the third space (133)**.

Due to the above structure, for example, when the separator (134) for partitioning between the first space (131) and the third space (133) is defective in sealing (joining), fluid for inspection leaking out from the defective sealing portion leaks outside from the hole (135) without entering the second space (132).

If sealing is defective in a portion other than the separator (134) which partitions between the first space (131) and the third space (133), fluid for inspection leaks outside from the defective portion.

Consequently, according to the present invention, inspection of the heat exchanger, in which two types of heat exchangers are integrated into one body, can be easily conducted.

Both the tubes (111, 121) may be provided extending in the vertical direction, and the hole (135) may be provided in the header tank (130) on the lower side.

Due to the foregoing, it becomes possible to prevent rainwater etc. from entering the header tank (130) through the hole (135). Therefore, it is possible to prevent corrosion of the heat exchanger caused by rainwater etc.

The temperature of the first fluid may be higher than that of the second fluid.

The engine coolant may flow in the first tubes (111) and the electric system coolant for cooling an electric motor and a control circuit for the motor may flow in the second tubes (121).

The header tank (130) may include a core plate (130*a*) into which the longitudinal end portions of the first tubes (111), the second tubes (121) and the third tubes (140) are inserted and a tank body (130*b*) for defining the space in the header tank together with the core plate (130*a*), and the tubes (111, 121, 140), the fins (112, 122, 141) and the core plate (130*a*) may be made of aluminum and the tank body (130*b*) may be made of resin.

Alternatively, the header tank (130) may include a core plate (130*a*) into which the longitudinal end portions of the first tubes (111), the second tubes (121) and the third tubes (140) are inserted and a tank body (130*b*) for defining the space in the header tank together with the core plate (130*a*), and the tubes (111, 121, 140), the fins (112, 122, 141), the core plate (130*a*), the tank body (130*b*) and the separator (134) may be made of aluminum.

In this case, the core plate (130*a*) and the separator (134) may be joined to each other by means of brazing.

The present invention provides another embodiment of a heat exchanger comprising: a plurality of first tubes (111) made of metal in which a first fluid circulates; a plurality of second tubes (121) made of metal in which a second fluid circulates; header tanks (130) made of metal communicating with both the tubes (111, 121), the header tanks (130) being arranged at both longitudinal end sides of both the tubes (111, 121); and two pieces of separators (134) made of metal for dividing a space in the header tank (130) into a first space (131) communicating with the first tubes (111) and a second space (132) communicating with the second tubes (121), the two pieces of separators (134) composing a third space (133) between the first space (131) and the second space (132); wherein the two pieces of separators (134) are joined by brazing to the header tank (130) under the condition that the two pieces of separators (134) are inserted from the slit hole (130*e*) formed in the header tank (130) into the header tank (130), and a hole (135) for communicating the third space (133) with the outside of the header tank (130) is formed in the third space corresponding portion (130*d*) corresponding to the third space (133) in the header tank (130).

Due to the foregoing, flux can be coated on the separator (134) from the hole (135) after the separator (134) has been incorporated into the header tank (130). Accordingly, there is no possibility of the occurrence of such a problem that flux coated on the surface of the separator (134) is removed when the separator (134) is inserted into the slit hole (130*e*). Therefore, the separator (134) and the header tank (130) can be excellently brazed to each other.

It is possible to repair a defective join of the separator (134) to the header tank (130) from the hole (135). Therefore, even if the separator (134) and the header tank (130) are defectively brazed to each other, the defective brazing join portion can be easily repaired, and thus the yield of the product can be increased.

Further, the present invention provides a method of manufacturing the heat exchanger described above, comprising the steps of: coating flux on the separator (134) after the separator (134) has been inserted into the header tank (130); and then brazing the separator (134) and the header tank (130) to each other.

Due to the foregoing, the separator (134) and the header tank (130) can be excellently brazed to each other.

Furthermore, the present invention provides a method of manufacturing the heat exchanger described above, further comprising the step of inspecting and repairing a brazed portion of the separator (134) and the header tank (130) after the separator (134) and the header tank (130) have been brazed to each other.

Due to the foregoing, the defective brazing join portion can be easily repaired, and thus the yield of the product can be increased.

Incidentally, the reference numerals in parentheses attached to the respective means represent correspondence to the specific means included in the embodiments described later.

BRIEF DESCRIPTION OF THE DRAWINGS

The present invention will be more clearly understood from the description as set below with reference to the accompanying drawings, wherein.

DESCRIPTION OF THE PREFERRED EMBODIMENTS

Figure 1:
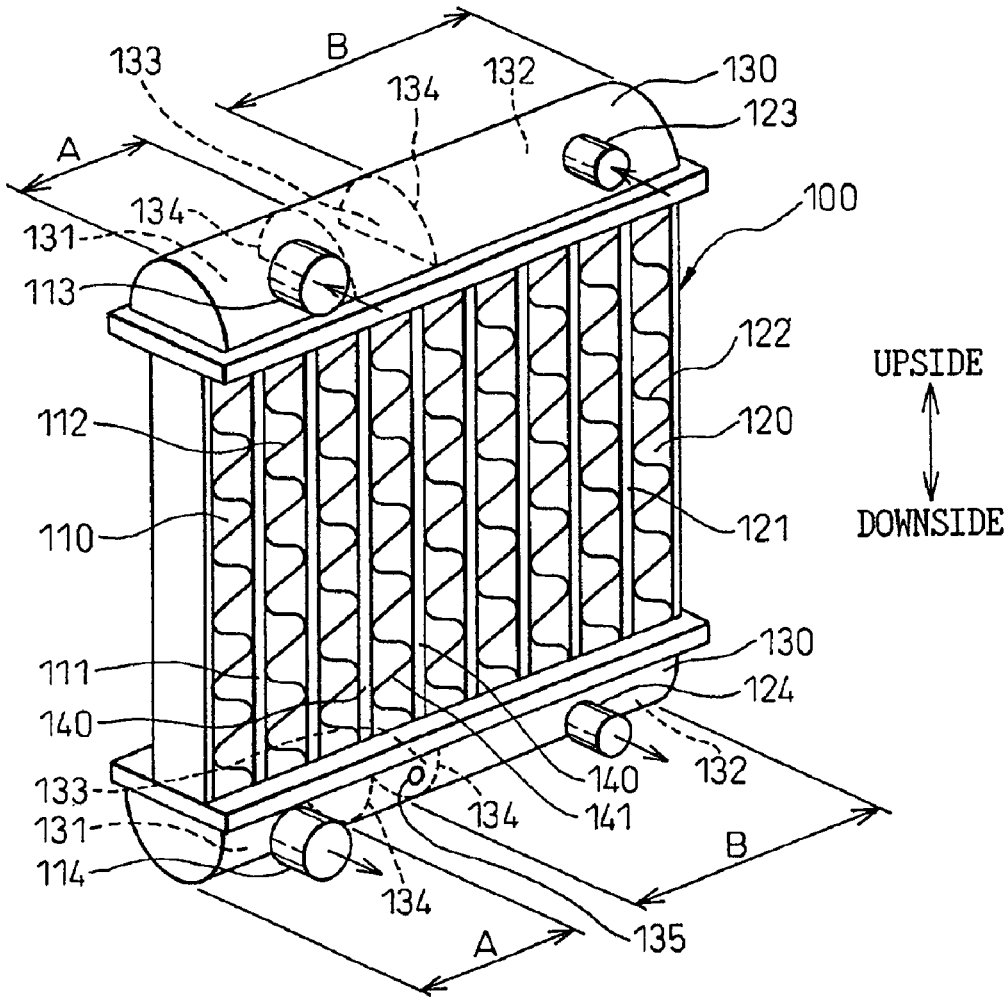
FIG. 1 is a perspective view of a radiator according to the first embodiment of the present invention.

In the following embodiments, each of the heat exchanger of the present invention is applied to a radiator used for a hybrid automobile. FIG. 1 is a perspective view of the radiator 100 of the first embodiment of the present invention.

Reference numeral 111 indicates the first tube made of aluminum in which the engine coolant (first fluid) for cooling an engine (not shown) by circulating in the engine is circulated. Reference numeral 121 indicates the second tube made of aluminum in which the electric system coolant (second fluid) for cooling an electric motor and a control circuit for controlling the motor by circulating in the electric motor and the control circuit, such as an inverter circuit, is circulated.

In this case, in the range A shown in FIG. 1, there are provided a plurality of first tubes 111, and in the range B shown in FIG. 1, there are provided a plurality of second tubes 121. The size and shape of the tubes 111 are the same as those of the tubes 121.

Between the first tubes 111, there are provided first cooling fins (heat transfer fins) 112 which are formed into a wave-shape for facilitating heat exchange, and also between the second tubes 121, there are provided second cooling fins (heat transfer fins) 122 which are formed into a wave-shape for facilitating heat exchange. The size and shape of the first cooling fins 112 are the same as those of the second cooling fins 122. These cooling fins 112, 122 (which will be referred to as fins hereinafter) are brazed to the tubes 111, 121.

On both longitudinal end sides of both tubes 111, 121, there are provided header tanks 130 which are communicated with both of the first tubes 111 and the second tubes 121. In each header tank 130, there are provided two pieces of separators (partition walls) 134 for dividing a space in the header tank 130 into three spaces 131 to 133.

In this case, the space 131 (which will be referred to as the first space 131 hereinafter) is communicated with the first tubes 111, and the engine coolant is supplied from the first space 131 on the upper side to the first tubes 111, and the engine coolant, which has completed heat exchange, is collected by the first space 131 on the lower side.

Also, the space 132 (which will be referred to as the second space 132 hereinafter) is communicated with the second tubes 121, and the electric system coolant is supplied from the second space 132 on the upper side to the second tubes 121, and the electric system coolant, which has completed heat exchange, is collected by the second space 132 on the lower side.

Accordingly, in the radiator 100, the portion of the range A shown in FIG. 1 composes the first radiator used for the engine coolant, and the portion of the range B shown in FIG. 1 composes the second radiator used for the electric system coolant.

In this connection, reference numeral 113 indicates an inlet of the engine coolant, and reference numeral 114 indicates an outlet of the engine coolant. Reference numeral 123 indicates an inlet of the electric system coolant, and reference numeral 124 indicates an outlet of the electric system coolant.

Figure 2:
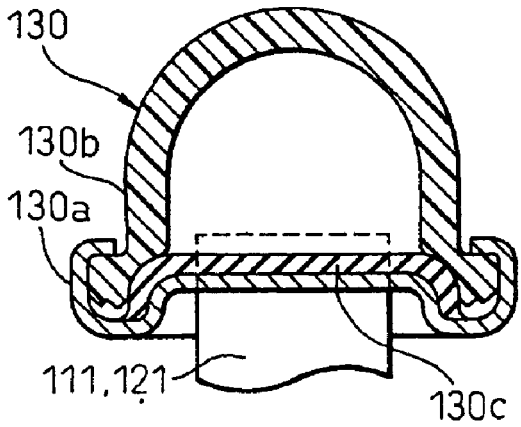
FIG. 2 is a cross-sectional view showing a header tank of the radiator according to the first embodiment of the present invention.

In this connection, as shown in FIG. 2, the header tank 130 includes: a core plate 130*a* made of aluminum to which the end portions in the longitudinal direction of both tubes 111, 121 are joined by brazing; and a tank body 130*b* made of resin composing a space in the header tank 130 together with the core plate 130*a*.

In order to ensure the sealing property, a portion of the core plate 130*a* is bent (plastically deformed) under the condition that the packing 130*c* is interposed between the core plate 130*a* and the tank body 130*b*, so that the core plate 130*a* and the tank body 130*b* are fixed to each other by calking.

Figure 3:
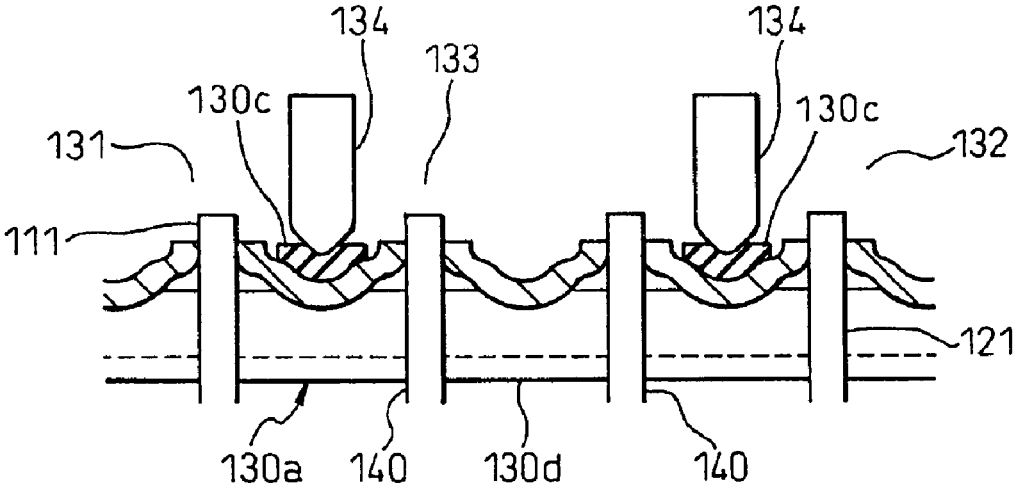
FIG. 3 is a partial cross-sectional view showing the header tank of the radiator according to the first embodiment of the present invention.

The separator 134 is formed in such a manner that the separator 134 is integrated with the tank body 130*b*. As shown in FIG. 3, a gap between the separator 134 and the core plate 130*a* is water-tightly sealed by the packing 130*c*. As shown in FIG. 1, in the third space 133 in the header tank 130 (tank body 130*b*) on the lower side, there is formed a hole 135 for communicating the third space 133 with the outside of the header tank 130.

In this connection, as shown in FIG. 3, the dummy tubes 140, which are the third tubes, and the size and shape of which are the same as those of the first tubes 111 and the second tubes 121, are joined to a portion 130*d* corresponding to the third space 133 of the core plate 130*a* (header tank 130) (which will be referred to as a third space corresponding portion 130*d* hereinafter).

As shown in FIG. 1, between these dummy tubes 140 and also between the dummy tube 140 and the first tube 111 and also between the dummy tube 140 and the second tube 121, there are provided fins 141, the size and shape of which are the same as those of the fins 112, 122. These fins 141 are also joined by brazing to the corresponding tubes 111, 121, 140.

In this embodiment, as described later, the fins 141 are provided mainly for the object of enhancing the mechanical strength, and the heat transfer effect (heat radiating effect) is not expected so much.

Next, a method of inspecting the leakage of the radiator 100 will be briefly described below.

1. In the case of inspecting the first radiator 110
   While the outlet 114 is closed, He gas is charged from the inlet 113 at a predetermined pressure. When He gas is detected outside the first radiator 110, it is assumed that He gas is leaking from any portion of the first radiator 110 because either joining or sealing is defective. When He gas is not detected outside the first radiator 110, it is assumed that there is no leakage in the first radiator 110, that is, neither joining nor sealing is defective.
2. In the case of inspecting the second radiator 120
   While the outlet 124 is closed, He gas is charged from the inlet 123 at a predetermined pressure. When He gas is detected outside the second radiator 120, it is assumed that He gas is leaking from any portion of the second radiator 120 because joining is defective or sealing is defective. When He gas is not detected outside the second radiator 120, it is assumed that there is no leakage in the second radiator 120, that is, neither joining nor sealing is defective.

In this connection, in this example, while the outlets 114, 124 are closed, He gas is charged from the inlets 113, 123. On the contrary, He gas may be charged from the outlets 114, 124 while the inlets 113, 123 are closed.

Next, the characteristic of this embodiment will be described below.

In this embodiment, the size and shape of the dummy tubes 140 are made to be the same as those of the first tubes 111 and the second tubes 121, and the size and shape of the first fins 112 and the second fins 122 are made to be the same as those of the fins 141. Therefore, when assembling the heat exchanger, it is possible to successively laminate the tubes and the fins without distinguishing the dummy tubes 140 from the first tubes 111 and the second tubes 121 and also without distinguishing the first fins 112 and the second fins 122 from the fins 141. Accordingly, the working efficiency of assembling the heat exchanger can be enhanced.

The dummy tubes 140, the size of which is the same as that of the first tubes 111 and the second tubes 121, are used as the structural members and, further the fins 141, the size of which is the same as that of the first fins 112 and the second fins 122, are joined. Therefore, when the radiator 100 is manufactured, it is possible to assemble the radiator 100 of this embodiment, in the same manufacturing line (process) in which the conventional radiator having no separator 134 is manufactured, by only changing the header tank 130 (tank body 130*b*).

Accordingly, it is possible to assemble the radiator, in which two types of radiators are integrated into one body, without greatly changing the manufacturing line (manufacturing process).

Between the first space 131 composing the header tank of the first radiator 110 and the second space 132 composing the header tank of the second radiator 120, the third space 133 is formed which is separated by the separators 134. Further, in the third space 133 on the lower side, the hole 135 is formed which communicates the third space 133 with the outside of the header tank 130. Therefore, for example, when conducting the leakage inspection of the first radiator 110, in the case that the separator 134 for separating the first space 131 from the third space 133 is defectively sealed, He gas, which has leaked out from the defective sealing portion, leaks outside from the hole 135 without entering the second space 132.

If a portion other than the separator 134 to separate the first space 131 from the third space 133 is defectively sealed, He gas leaks outside from the defective sealing portion.

As described above, according to this embodiment, the leakage inspections of the first radiator 110 and the second radiator 120 can be easily conducted. Therefore, the leakage inspection of the radiator 100, in which the first radiator 110 and the second radiator 120 are integrated into one body, can be easily conducted.

Since the hole 135 is formed in the header tank 130 on the lower side, it is possible to prevent rainwater etc. from entering the header tank 130 through the hole 135. Accordingly, corrosion of the heat exchanger by rainwater etc. can be prevented. Therefore, the deterioration of durability of the radiator 100 can be prevented.

Incidentally, the appropriate temperature of the engine coolant and that of the electric system coolant are different from each other. Therefore, a quantity of thermal expansion of the first tubes 111 and that of the second tubes 121 are different from each other. As a result, compression stress or tensile stress (which will be referred to as thermal stress hereinafter) is caused in the first tubes 111 and the second tubes 121.

In this connection, in this embodiment, the third space corresponding portion 130*d* located between the first space 131 and the second space 132 functions as a portion to relieve thermal stress caused in the first tube 111 and the second tube 121.

Accordingly, it is possible to reduce thermal stress caused by a difference between the quantity of thermal expansion of the first tubes 111 and the quantity of thermal expansion of the second tubes 121. Therefore, the tubes can be prevented from being cracked.

Concerning the third space corresponding portion 130*d*, the fins 141 are joined between the dummy tubes 140 and also between the dummy tubes 140 and both the tubes 111, 121. Therefore, rigidity of the entire core is not impaired.

In this connection, in this embodiment, the fins 141 are arranged in the radiator. However, it should be noted that the present invention is not limited by the above specific embodiment, that is, the fins 141 may be abolished.

Next, the second embodiment of the present invention will be explained below.

Figure 4:
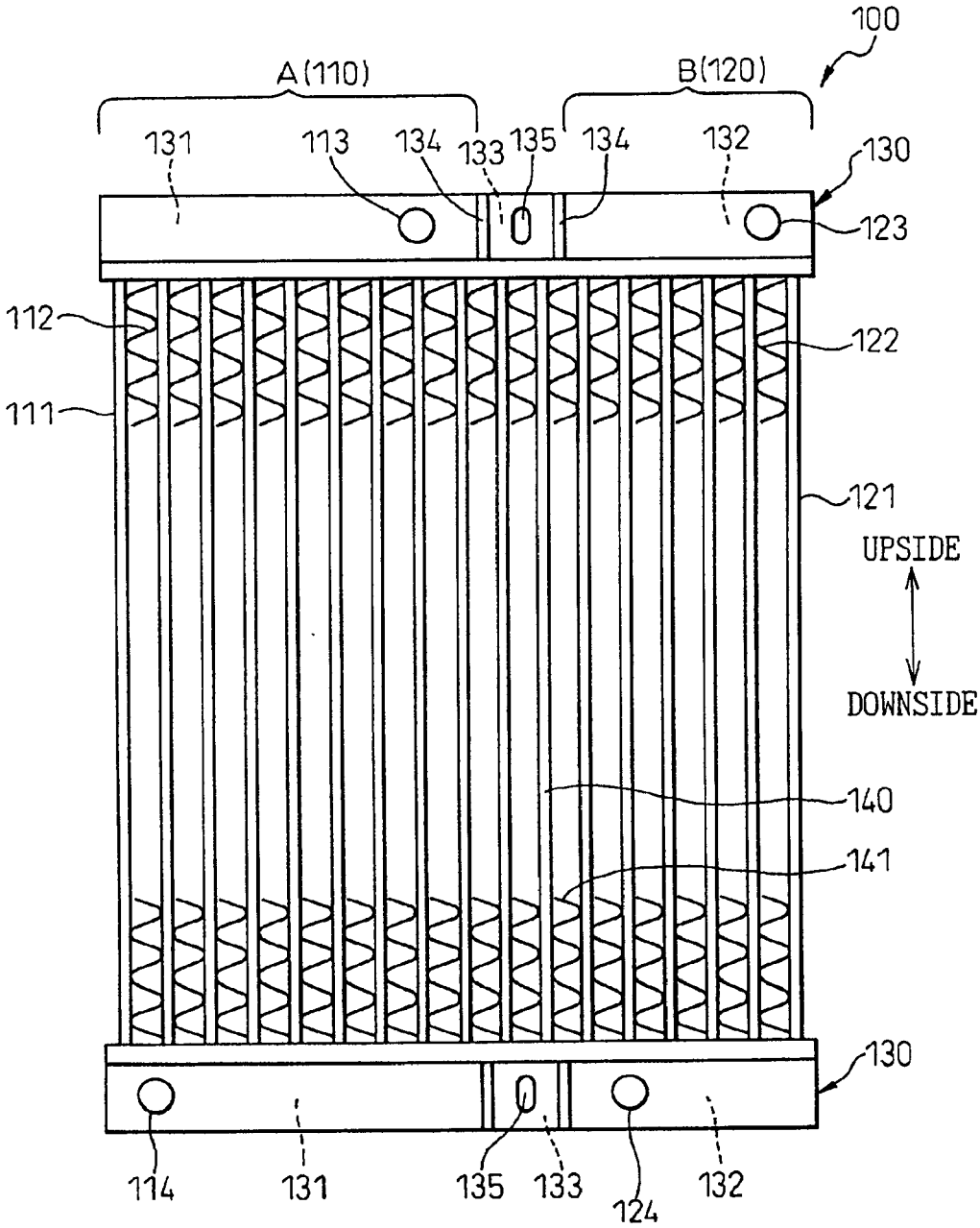
FIG. 4 is a front view showing a radiator according to the second embodiment of the present invention.

FIG. 4 is a front view of the radiator 100 according to the second embodiment of the present invention.

Figure 5:
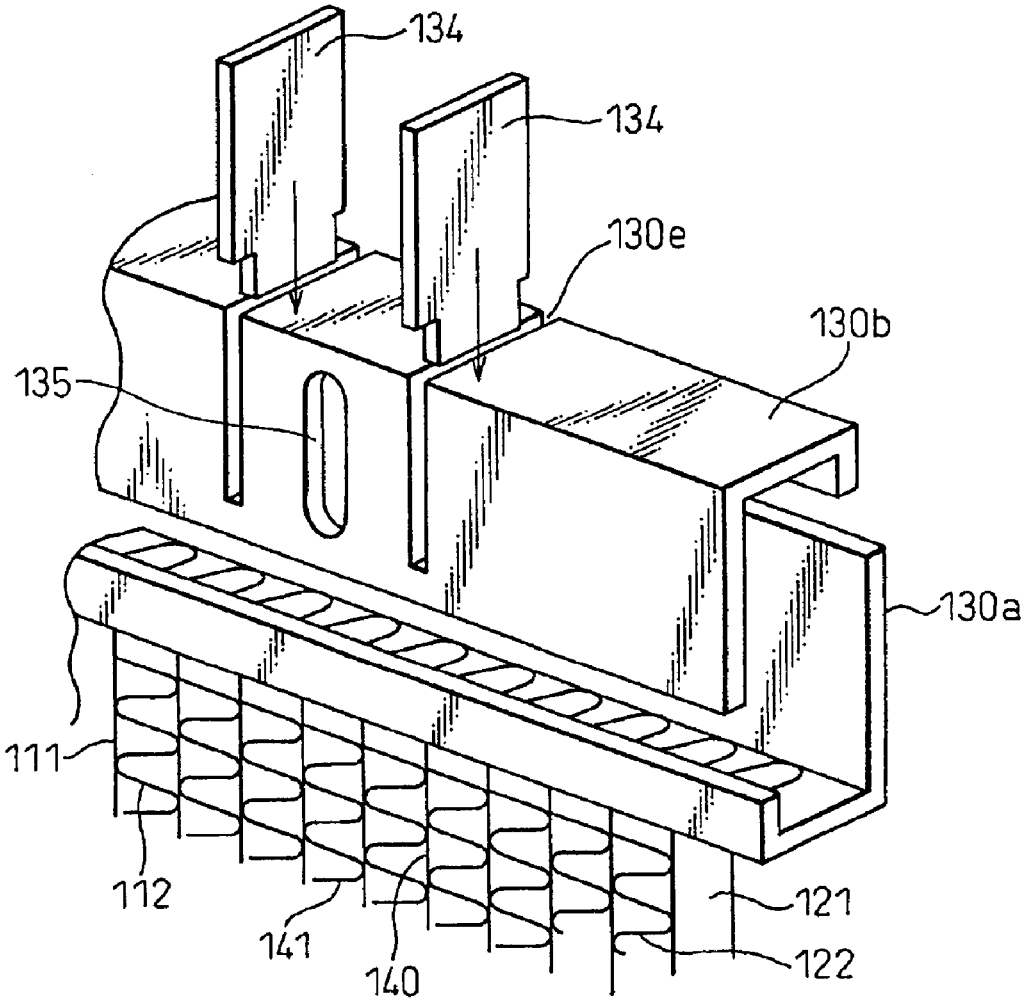
FIG. 5 is a partial exploded perspective view showing a header tank of the radiator according to the second embodiment of the present invention.

The basic structure of the radiator 100 according to this embodiment is substantially the same as that of the radiator 100 of the first embodiment. Like reference characters are used to indicate like parts in various views. Therefore, portions of the second embodiment shown in FIG. 4 corresponding to the portions of the radiator 100 of the first embodiment are represented by the same reference characters. In the radiator 100 of the second embodiment, as shown in FIG. 5, the header tank 130 is composed in such a manner that the core plate 130*a* made of aluminum, to which the end portions in the longitudinal direction of both the tubes 111, 121 are joined, is brazed to the tank body 130*b* made of aluminum which composes a space in the header tank 130 together with the core plate 130*a*. In this case, the separators 134 are brazed to the header tank 130 under the condition that they are inserted into the slit holes 130*e* formed in the tank body 130*b*.

As shown in FIG. 4, in the third space 133 in the header tank 130 (tank body 130*b*), there is formed a hole 135, the shape of which is an oval, and which communicates the third space 133 with the outside of the header tank 130. Further, the dummy tubes 140, which are the third tubes in which the coolant is not circulated, and the size and shape of which are the same as those of the first tubes 111 and the second tubes 121, are joined to the third space 133.

In the same manner as that of the radiator 100 according to the first embodiment, between these dummy tubes 140 and also between the dummy tube 140 and the first tube 111 and also between the dummy tube 140 and the second tube 121, there are provided fins 141, the size and shape of which are the same as those of the fins 112, 122. These fins 141 are also joined by brazing to the corresponding tubes 111, 121, 140.

In this embodiment, the fins 141 are provided mainly for the object of enhancing the mechanical strength, and a strong heat transfer effect (heat radiating effect) is not expected. This is also the same as in the case of the radiator 100 of the first embodiment.

Next, the method of manufacturing the radiator 100 of this embodiment will be briefly described as follows.

The tank body 130*b* is manufactured as follows. An aluminum plate, one side of which is clad with brazing material, on the other side of which a sacrificial corrosion layer is formed, is subjected to press forming, so that, while the slit hole 130*e* is being formed as shown in FIG. 5, the aluminum plate is formed into a substantial L-shape (J-shape) so that the sacrificial corrosion layer can be the inner wall side of the header tank 130. In the same manner, the core plate 130*a* is manufactured as follows. An aluminum plate, one side of which is clad with brazing material and the other side of which a sacrificial corrosion layer is formed, is subjected to press forming, so that the aluminum plate is formed into a substantial L-shape (J-shape) so that the sacrificial corrosion layer can be the inner wall side of the header tank 130.

In this connection, the sacrificial corrosion layer is defined as a layer made of metal having a higher ionization tendency than that of a base metal (core material) so that the corrosion of the base metal can be prevented.

The separators 134 are manufactured in such a manner that an aluminum plate, both sides of which are clad with brazing material, is punched.

In this connection, the tubes 140, 111, 121 are manufactured in such a manner that a aluminum plate is bent and welded by means of electric welding. The fins 112, 122, 141 are manufactured in such a manner that an aluminum plate, both sides of which are clad with brazing material, is plastically deformed into corrugations by a forming machine with a gear-shaped roller.

Then, flux is coated on the outer side of each of the core plate 130*a* and the tank body 130*b*, that is, flux is coated on a side opposite to the side on which the sacrificial corrosion layer is formed. After that, the core plate 130*a*, tank body 130*b*, tubes 140, 111, 121, fins 112, 122, 141 and separator 134 are assembled, and these assembled members are kept in the assembled state by a jig such as a wire.

Next, after flux is coated on the separator 134 from the hole 135, the assembled radiator is heated in a heating furnace, so that the core plate 130*a*, tank body 130*b*, tubes 140, 111, 121, fins 112, 122, 141 and separator 134 are joined to each other by brazing.

Then, inert gas such as He gas is charged into the radiator 100 (the first radiator 110 and the second radiator 120), and inspection is conducted to check whether or not the core plate 130*a* and the tank body 130*b* are perfectly joined to each other without having any defect, also to check whether or not the core plate 130*a* and the tubes 111, 121 are perfectly joined to each other without having any defect, also to check whether or not the core plate 130*a* and the separator 134 are perfectly joined to each other without having any defect, and also to check whether or not the tank body 130*b* and the separator 134 are perfectly joined to each other without having any defect. When a defective join portion is found, repairing is conducted in such a manner that resin material is infilled.

In this case, a defective join portion between the core plate 130*a* and the separator 134 is repaired by infilling resin material into the defective join portion from the hole 135, and also a defective join portion between the tank body 130*b* and the separator 134 is repaired by infilling resin material into the defective join portion from the hole 135.

Figure 6:
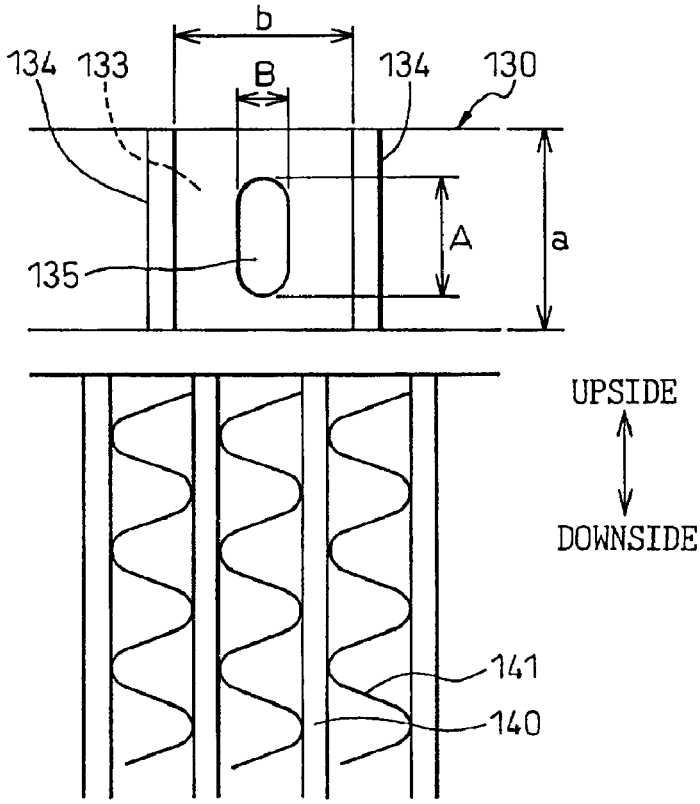
FIG. 6 is a partial front view showing a hole of the header tank of the radiator according to the second embodiment of the present invention.
Figure 7:
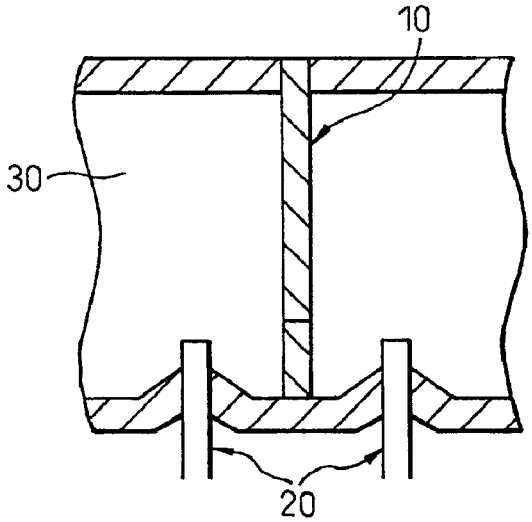
FIG. 7 is a partial cross-sectional view showing a header tank of the radiator according to the prior art.

In this connection, it is preferable that the size of the hole 135 is sufficiently large to allow flux coating work and join portion repairing work. In this embodiment, as shown in FIG. 6, the direction of the major axis of the hole 135 is coincided with the longitudinal direction of the tube 140. Also, the length A of the major axis of the hole 135 is made to be not less than 0.3 times and not more than 0.5 times as long as the length "a" of the portion of the third space 133 which is parallel with the major axis. The length B of the minor axis of the hole 135 is made to be not less than 0.25 times and not more than 0.65 times as long as the length "b" of the portion of the third space 133 which is parallel with the minor axis.

Next, the characteristic of this embodiment will be described below.

In this embodiment, since the hole 135 is formed in the third space 133, it is possible to coat flux on the separator 134 after the separator 134 has been assembled to the header tank 130 as described before.

Accordingly, such a problem that the flux coated on the surface of the separator 134 is removed when the separator 134 is inserted into the slit hole 130*e* is not caused. Therefore, the separator 134 and the header tank 130 can be excellently brazed to each other.

In the case where the separator 134 and the header tank 130 are defectively joined to each other, it is possible to repair the defective portion from the hole 135. Therefore, even if the separator 134 and the header tank 130 are defectively joined to each other, the defective portion can be easily repaired, and thus the yield of the product can be increased.

Incidentally, in this embodiment, the tubes are extended in the vertical direction. However, it should be noted that the present invention is not limited to the specific embodiment. For example, the tubes may be extended in the horizontal direction.

In this embodiment, it is possible to assemble the heat exchanger 100 by successively laminating the tubes and fins without distinguishing the dummy tubes 140 from the first tubes 111 and the second tubes 121 and also without distinguishing the first fins 112 and the second fins 122 from the dummy fins 141 in the process of assembling the heat exchanger. Accordingly, it is possible to enhance the working efficiency. However, it should be noted that the present invention is not limited to the specific embodiment. For example, the dummy tubes 140 and the dummy fins 141 may be abolished and a simple heat-insulating space may be formed.

Although, in each embodiment described above, the heat exchanger of the present invention is applied to a hybrid automobile, it should be noted that the present invention is not limited to the specific embodiment, but the heat exchanger of the present invention may be applied to other applications.

Although, in each embodiment described above, He gas is used as fluid for inspecting leakage, it should be noted that the present invention is not limited to the specific embodiment, but another gas or fluid may be used for inspection.

While the invention has been described by reference to specific embodiments chosen for purpose of illustration, it should be apparent that numerous modifications could be made thereto by those skilled in the art without departing from the basic concept and scope of the invention.

What is claimed is:

1. A heat exchanger comprising:

a plurality of first tubes made of metal in which a first fluid circulates;

a plurality of second tubes made of metal in which a second fluid circulates;

a plurality of third tubes disposed between the first and second plurality of tubes;

a pair of header tanks made of metal communicating with the first tubes, the second tubes and the third tubes; and two separators made of metal disposed in each of the header tanks to divide a chamber in each of the header tanks into a first space communicating with the first tubes and a second space communicating with the second tubes, the two separators defining a third space between the first space and the second space communicating with the third tubes; wherein the two separators are joined by brazing to a respective header tank under the condition that the two separators are inserted from a slit hole formed in the respective header tank;

a hole for communicating the third space with the outside of the respective header tank is formed in the respective header tank; and there is no fluid inlet or outlet associated with either of the third spaces.

2. A heat exchanger according to claim 1, wherein the third tubes are provided extending in the vertical direction, and the hole is provided in the header tank on the lower side.

3. A heat exchanger according to claim 1, wherein the temperature of the first fluid is higher than that of the second fluid.

4. A heat exchanger according to claim 1, wherein the first fluid is engine coolant which flows in the first tubes and the second fluid is electric system coolant for cooling an electric motor and a control circuit for the motor which flows in the second tubes.

5. A heat exchanger according to claim 1, wherein each of the header tanks includes a core plate into which the longitudinal end portions of the first tubes, the second tubes and the third tubes are inserted and a tank body for defining the chamber in the header tank together with the core plate, and wherein the first tubes, the second tubes, the third tubes, the fins, and the core plate are made of aluminum and the tank body is made of resin.

6. A heat exchanger according to claim 1, wherein the header tank includes a core plate into which the longitudinal end portions of the first tubes, the second tubes and the third tubes are inserted and a tank body for defining the chamber in the header tank together with the core plate, and wherein the first tubes, the second tubes, the third tubes, the fins, the core plate, the tank body and the separator are made of aluminum.

7. A heat exchanger according to claim 6, wherein the core plate and the separator are joined to each other by means of brazing.

8. A heat exchanger according to claim 1, wherein the third space forms a heat-insulating space for insulating between the first space and the second space.

9. A method of manufacturing a heat exchanger, the heat exchanger comprising: a plurality of first tubes made of metal in which a first fluid circulates; a plurality of second tubes made of metal in which a second fluid circulates; a plurality of third tubes disposed between said first and second plurality of tubes; a pair of header tanks made of metal communicating with the first tubes, the second tubes and the third tubes, the header tanks being arranged at both longitudinal end sides of the first tubes, the second tubes and the third tubes; and two separators made of metal disposed in each of the header tanks divide a chamber in each of the header tanks into a first space communicating with the first tubes and a second space communicating with the second tubes, the two separators defining a third space between the first space and the second space communicating with the third tubes; wherein the two separators are joined by brazing to a respective header tank under the condition that the two separators are inserted from a slit hole formed in the respective header tank, a hole for communicating the third space with the outside of the respective header tank is formed in the respective header tank, and there is no fluid inlet or outlet associated with either of the third spaces, the method of manufacturing the heat exchanger comprising the steps of: coating flux on the separators after the separators have been inserted into the respective header tank; brazing the separators and the respective header tank to each other; and conducting an inspection for leaks by using the hole.

10. A method of manufacturing a heat exchanger according to claim 9, further comprising the step of inspecting and repairing a brazed portion of the separators and the respective header tank after the separators and the respective header tank have been brazed to each other.

11. A heat exchanger comprising:

a plurality of first tubes in which a first fluid circulates;

first fins for facilitating heat exchange, the first fins being arranged between the first tubes;

a plurality of second tubes in which a second fluid circulates;

second fins for facilitating heat exchange, the second fins being arranged between the second tubes;

a plurality of third tubes disposed between the first and second plurality of tubes;

a pair of header tanks communicating with the first and second plurality of tubes, the header tanks being arranged at both longitudinal end sides of the first and second plurality of tubes;

two separators disposed in each of the header tanks to divide a chamber in each of the header tanks into a first space communicating with the first tubes and a second space communicating with the second tubes, the two separators defining a third space between the first space and the second space communicating with the third tubes;

a hole for communicating the third space with the outside of the respective header tank is formed in the respective header tank; and there is no fluid inlet or outlet associated with either of the third spaces.

* * * * *